US010179422B2

(12) United States Patent
Lodi et al.

(10) Patent No.: US 10,179,422 B2
(45) Date of Patent: Jan. 15, 2019

(54) APPARATUS FOR PROCESSING A FLEXIBLE MATERIAL

(71) Applicant: CARTES S.R.L., Moglia (Mantova) (IT)

(72) Inventors: Mario Lodi, Carpi (IT); Carlo Stefano Lodi, Carpi (IT)

(73) Assignee: CARTES S.R.L., Moglia (IT)

( * ) Notice: Subject to any disclaimer, the term of this patent is extended or adjusted under 35 U.S.C. 154(b) by 157 days.

(21) Appl. No.: 15/277,320

(22) Filed: Sep. 27, 2016

(65) Prior Publication Data

US 2017/0087737 A1 Mar. 30, 2017

(30) Foreign Application Priority Data

Sep. 28, 2015 (IT) ..... 102015000055848

(51) Int. Cl.

| | |
|---|---|
| ***B26D 1/24*** | (2006.01) |
| ***B26D 1/40*** | (2006.01) |
| ***B26D 7/00*** | (2006.01) |
| ***B26F 1/38*** | (2006.01) |
| ***B31D 1/02*** | (2006.01) |
| ***B26D 7/26*** | (2006.01) |

(52) U.S. Cl.

CPC ..... *B26D 7/2635* (2013.01); *B26D 1/245* (2013.01); *B26D 7/265* (2013.01); *B26F 1/384* (2013.01); *B31D 1/021* (2013.01); *B31D 1/026* (2013.01); *B26D 1/405* (2013.01); *B26D 2007/005* (2013.01)

(58) Field of Classification Search

CPC ..... B26D 7/2635; B26D 1/245; B26D 7/265; B31D 1/026; B31D 1/021

See application file for complete search history.

(56) References Cited

U.S. PATENT DOCUMENTS 4,063,493 A * 12/1977 McEvers ..... B26D 1/626 493/370
4,770,078 A * 9/1988 Gautier ..... B26D 7/2614 83/344
5,048,387 A * 9/1991 Niitsuma ..... B41F 13/62 83/344

(Continued)

FOREIGN PATENT DOCUMENTS

DE 10 2013 208 909 A1 11/2014
EP 0 899 068 A2 3/1999

(Continued)

*Primary Examiner* — Sean M Michalski
(74) *Attorney, Agent, or Firm* — Pearne & Gordon LLP

(57) ABSTRACT

An apparatus for processing a flexible material (14) comprises:

a first roller (5) extending along a main axis (A1);

a second roller (6) extending along a longitudinal axis (A2), the first roller (5) and the second roller (6) being mutually co-operating to carry out an operation on the flexible material (14), an interspace (37) being defined between the first roller (5) and the second roller (6) though which the flexible material (14) can pass;

a pressing device for pushing the first roller (5) and the second roller (6) one towards another;

a position adjustment device for adjusting the relative position of the first roller (5) and the second roller (6), the position adjustment device being distinct from the pressing device.

11 Claims, 7 Drawing Sheets

(56) References Cited

U.S. PATENT DOCUMENTS 5,083,488 A * 1/1992 Stanley ..... B26D 7/2628 100/168
5,156,076 A * 10/1992 Rosemann ..... B26D 7/2628 100/168
5,174,185 A * 12/1992 Aichele ..... B26D 7/2628 83/346
5,388,490 A * 2/1995 Buck ..... B26D 7/2628 83/344
5,598,758 A * 2/1997 Chmelar ..... B23D 35/008 83/100
6,389,941 B1 * 5/2002 Michler ..... B26D 7/08 101/216
8,943,939 B2 * 2/2015 Demand ..... B26D 7/2614 83/337
9,902,083 B2 * 2/2018 Long ..... B26D 7/18
2005/0119099 A1 * 6/2005 Madern ..... B21B 31/02 493/144
2006/0048616 A1 * 3/2006 Grenier ..... B26D 7/20 83/13
2006/0257193 A1 * 11/2006 Aichele ..... B26D 7/22 400/621
2007/0101844 A1 * 5/2007 Spilker ..... B26D 7/2628 83/344
2012/0055305 A1 * 3/2012 Betti ..... B26D 1/626 83/436.3
2012/0255412 A1 * 10/2012 Dijon ..... B26D 1/405 83/344
2013/0000457 A1 * 1/2013 Oba ..... B26D 7/2628 83/344
2013/0042771 A1 * 2/2013 Alkhagen ..... B26D 5/007 101/23
2013/0283987 A1 * 10/2013 Pras ..... B26D 7/22 83/344
2014/0069248 A1 * 3/2014 Wang ..... B26D 7/265 83/629

FOREIGN PATENT DOCUMENTS

EP 2 656 988 A1 10/2013
WO 2006/040028 A1 4/2006

* cited by examiner

APPARATUS FOR PROCESSING A FLEXIBLE MATERIAL

The invention concerns an apparatus for processing a flexible material, such as a paper material or a polymer film, in particular in the form of a continuous strip. The apparatus of the invention can be used as a cutting apparatus, in particular for obtaining labels destined to be applied on containers, such as bottles, jars, trays or others besides, to be used in the food, cosmetic sector or the like.

Cutting apparatus are known that comprise a cutting roller and an counter roller, which cooperate for cutting labels from a continuous strip of flexible material. The strip passes through an interspace defined between the cutting roller and the counter roller and is cut by corresponding blades included in a cutting die supported by the cutting roller.

Respective circular rings are mounted at each end of the cutting roller and the counter roller, with respect to which the cutting roller and the counter roller are rotatable. The circular rings are instead arranged in a fixed position. Each circular ring associated to the cutting roller is arranged in contact with the corresponding circular ring associated to the counter roller. Thus the relative position of the cutting roller and the counter roller is determined, and, consequently, the height of the interspace defined between the cutting roller and the counter roller, in which the material to be cut is destined to pass.

The apparatus of known type further comprises a pressing device for pressing the cutting roller towards the counter roller with a predetermined pressure, so that the cutting roller can cut the flexible material. The pressing device comprises two pairs of wheels, each pair of wheels being arranged in contact with a circular ring associated to an end of the cutting roller. The wheels of a pair are united to one another by a connecting element, the position of which can be modified thanks to a mechanical drive system, with a consequent varying of the pressure with which the cutting roller is pushed towards the counter roller. By modifying the pressure with which the wheels act on the corresponding circular ring, it is possible to modify the thickness of the flexible material to be cut and/or of the cutting die.

A defect of the cutting apparatus of known type is that the apparatus enable varying the thickness of the material to be cut and/or of the cutting die within very strict limits. In fact, by regulating the pressure with which the cutting roller is pushed towards the counter roller, it is possible to make the system more rigid or alternatively more deformable, which has a rather limited influence on the relative position of the contrast roller and the cutting roller and, consequently, on the interval in which it can vary the thickness of the material to be cut and/or of the cutting die.

A further defect of the cutting apparatus of known type is that the regulations that have to be made to make the apparatus able to cut materials having a different thickness and/or to work with cutting dies of different thickness are rather complicated. In fact, the regulation of the pressure is not linearly translated in a variation of the reciprocal position of the cutting roller and the counter roller. Consequently, many attempts are necessary as well as a considerable experience on the part of the operator to modify the settings of the cutting apparatus acting on the pressing device.

Further, the cutting apparatus of known type do not enable using cutting dies which, following irregular wear, have a different thickness to the two ends of the cutting roller. When there is a situation of wear of the above-described type, it is therefore necessary to remove the worn cutting die and replace it with a new cutting die, with consequent losses of time and productivity, as well as costs for purchasing the new cutting die.

Examples of prior art devices, which suffer the above drawbacks, are disclosed in documents EP899068 and EP2656988.

An aim of the invention is to improve the known apparatus for processing a flexible material, in particular cutting apparatus.

A further aim is to provide an apparatus for processing a flexible material with a work tool, in which it is possible easily to modify the thickness of the flexible material to be processed.

A further aim is to provide an apparatus for processing a flexible material with a work tool, in which it is possible to use work tools having different thicknesses from one another, passing from a tool to another with relative ease.

A still further aim is to provide an apparatus for processing a flexible material with a work tool, which can operate with success also in a case in which the work tool has a variable thickness, due to irregular wear.

The invention discloses an apparatus for processing a flexible material comprising:

- a first roller and a second roller interacting mutually to carry out an operation on the flexible material, an interspace being defined between the first roller and the second roller in which the flexible material can pass;
- a pressing device for pushing the first roller and the second roller one towards another;
- a position adjustment device for adjusting the relative position of the first roller and the second roller, the position adjustment device being distinct from the pressing device.

The apparatus of the invention enables regulating the relative position of the first roller and the second roller, independently of the pressure with which the rollers are pushed towards one another by the relative pressing device. Owing to the position adjustment device, it is in fact possible to directly regulate the relative position of the first roller and the second roller, without having to act on the pressure applied by the pressing device. The relative position of the first roller and the second roller can therefore be regulated in a more immediate and rapid way with respect to the known apparatus, even by operators having little expertise.

In a version, the first roller and the second roller extend along respective axes.

The position adjustment device is configured for modifying the distance between the axes along which the first roller and respectively the second roller extend.

By varying the distance between the axes of the first roller and the second roller, it is possible to vary the height of the interspace between the first roller and the second roller. This enables making the apparatus of the invention suitable for processing flexible materials having a different thickness to one another. Further, by varying the distance between the axes of the first roller and the second roller, it is possible to use work tools having a different thickness to one another, which therefore have different volumes in the interspace defined between the first roller and the second roller.

In a version of the invention, the position adjustment device comprises a front adjustment device associated to a front end of the first roller and of the second roller, and a rear adjustment device associated to a rear end of the first roller and of the second roller.

The front adjustment device and the rear adjustment device are independent of one another.

By acting differently on the front adjustment device and on the rear adjustment device, it is possible to arrange the first roller and the second roller in a position in which the respective axes are inclined with respect to one another, i.e. not parallel to one another. In this way, the apparatus can also be made suitable for operating with unevenly worn work tools, i.e. which have, at an end of the first roller and the second roller, a different thickness with respect to the thickness that the work tool has at the other end of the first roller and the second roller. This enables maximising the working life of the work tool, and consequently limiting down times and the costs required for replacing the work tool.

The invention can be better understood and actuated with reference to the accompanying figures of the drawings, which illustrate a non-limiting embodiment thereof, in which.

Figure 1:
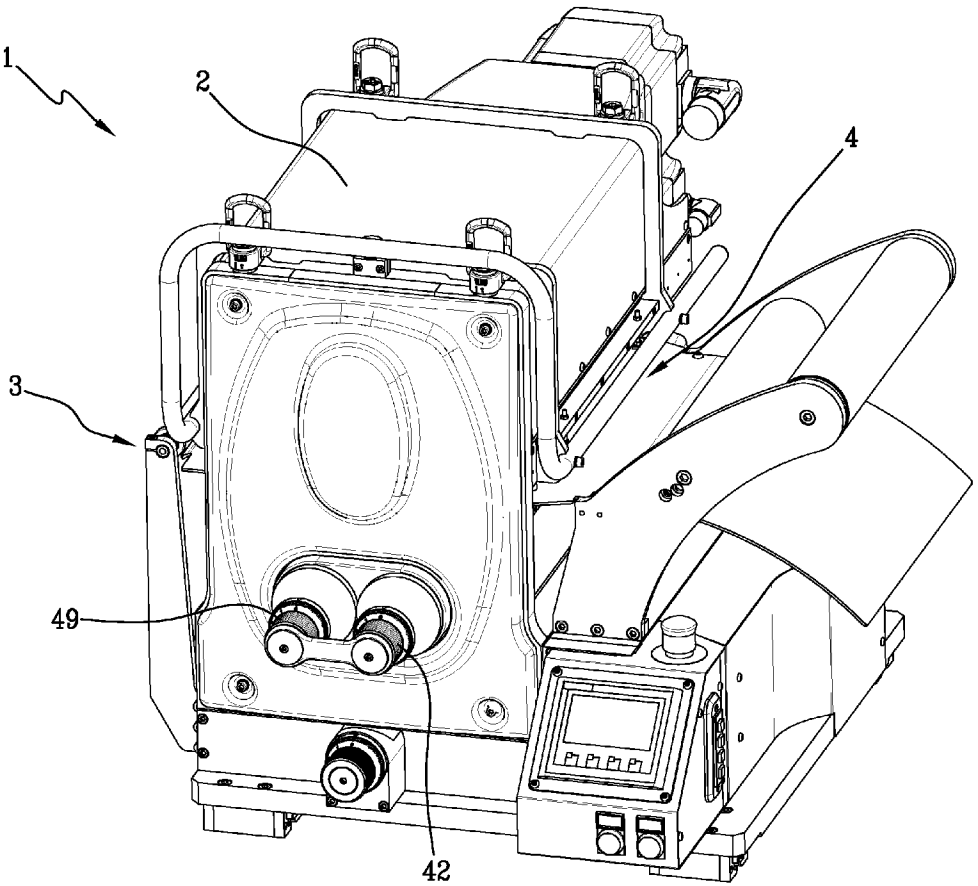
FIG. 1 is a perspective view showing the cutting apparatus.

FIG. 1 illustrates a cutting apparatus 1, which can be used for cutting discrete portions starting from a flexible material, in particular a material in a continuous strip. The cutting apparatus 1 is particularly suitable for producing labels, in particular self-adhesive labels, starting from a strip material 14 the structure of which can be of the type schematically shown in FIG. 6. In this case the strip material 14 comprises a support layer 10 to which a self-adhesive layer 11 is removably coupled. The cutting apparatus 1 enables cutting the self-adhesive layer 11 along a closed border corresponding to the perimeter of a label, without scoring the support layer 10. It is therefore possible to define on the self-adhesive layer 11 a plurality of labels, surrounded by portions of waste material. This can subsequently be detached from the support layer 10 and removed, with the aim of obtaining a continuous strip comprising a support layer 10 to which a plurality of self-adhesive labels are coupled, destined to be applied for example on bottles, containers or trays to be used in the food, cosmetic or other sectors.

As shown in FIG. 1, the cutting apparatus 1 comprises a casing 2 internally of which the components that enable cutting the labels are housed. An inlet 3 is included in the casing 2 for the strip material 14 comprising the support layer 10 coupled to the self-adhesive layer 11 to be cut. An outlet 4 is further included from which the strip material 14 after the self-adhesive layer 11 has been cut along a plurality of closed borders, each of which corresponds to the perimeter of a label.

Also included are advancement means, not illustrated, for advancing the strip material 14 continuously from the inlet 3 to the outlet 4.

Figure 2:
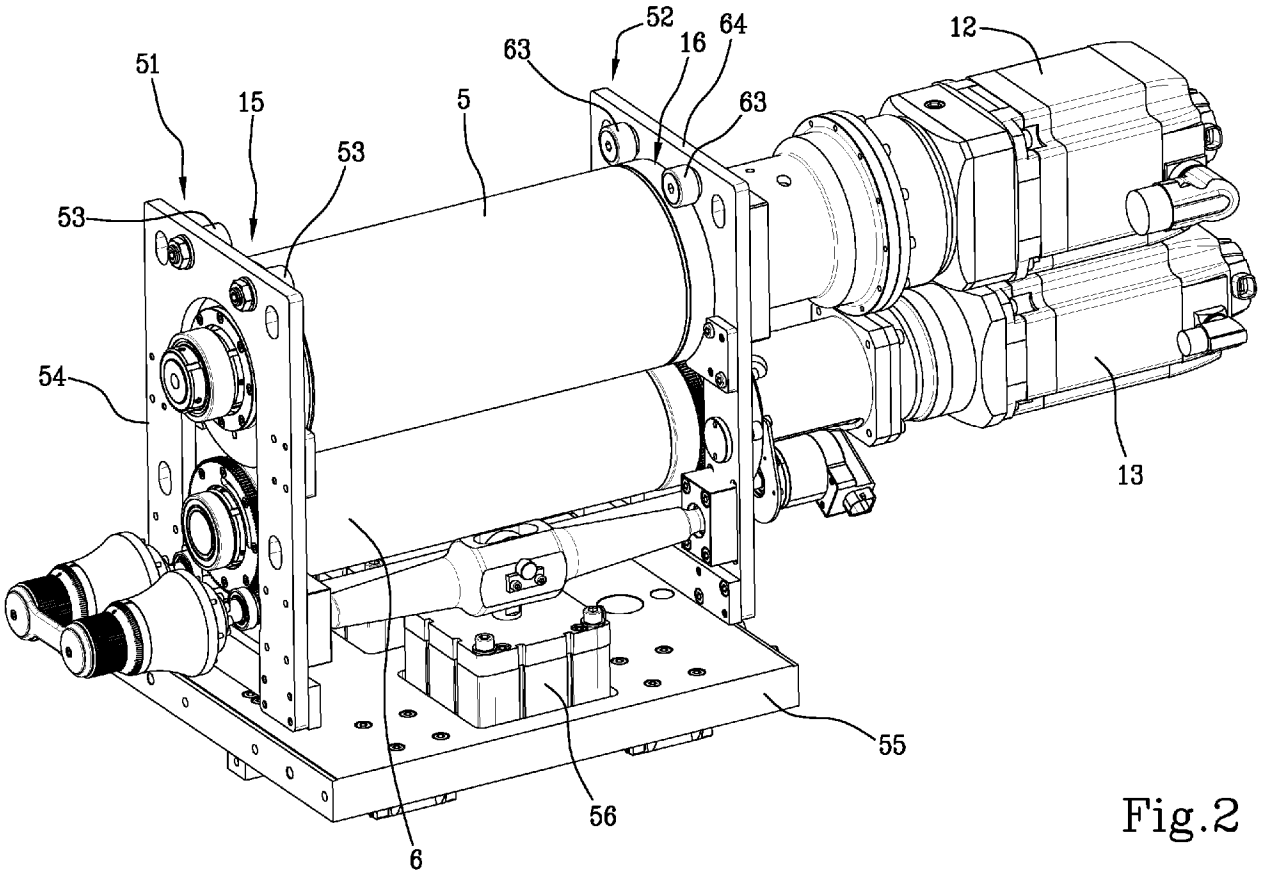
FIG. 2 is a perspective view of the cutting apparatus of FIG. 1, wherein some parts of the external casing have been removed.

As shown in FIG. 2, the cutting apparatus 1 comprises a first roller or cutting roller 5 and a second roller or counter roller 6, cooperating with one another for cutting the labels.

Figure 6:
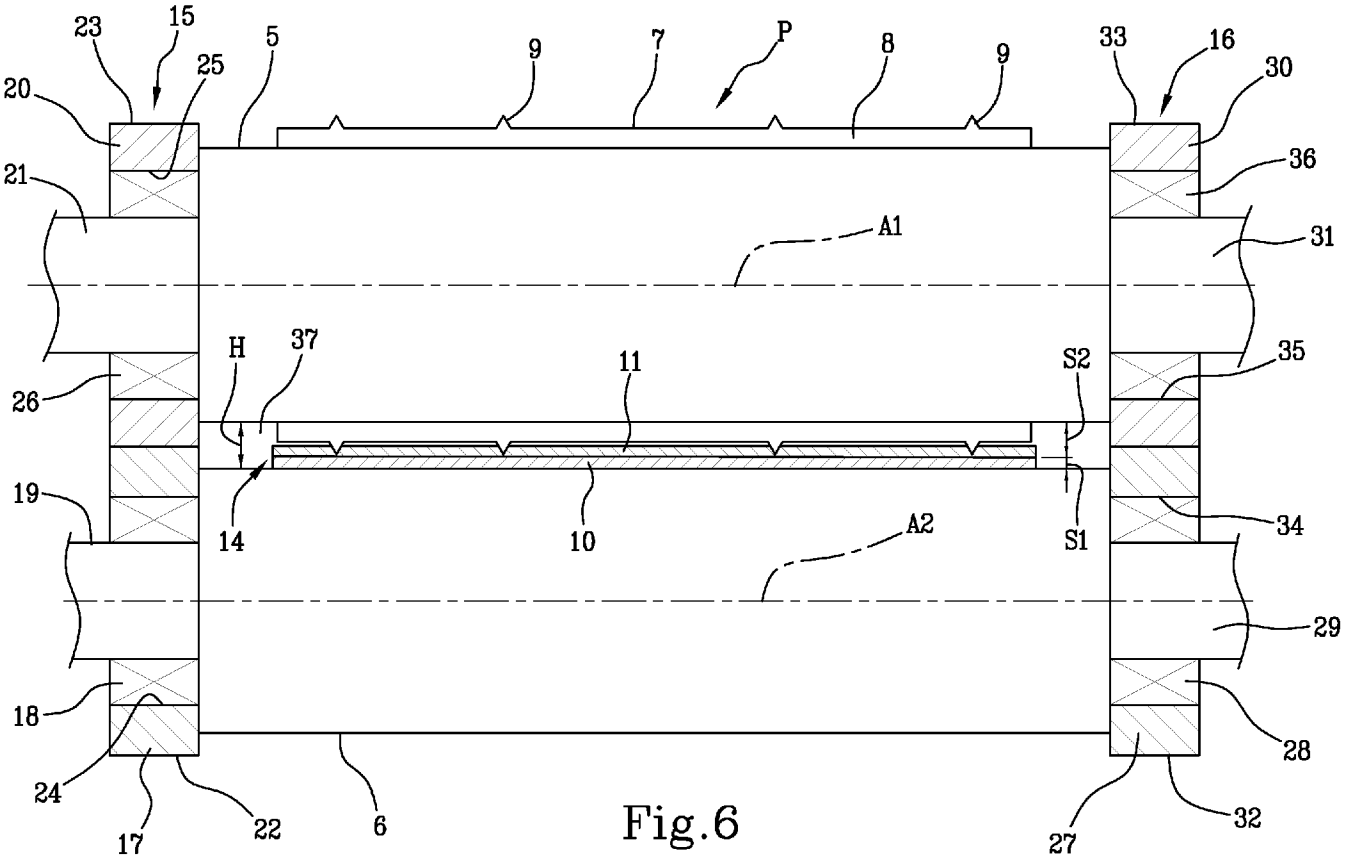
FIG. 6 is a schematic view, not in scale, partly sectioned, highlighting a pair of rollers of the cutting apparatus of FIG. 1.

In particular, the cutting roller 5 can be configured for supporting a work tool, in particular a cutting die 7, visible in FIG. 6. The cutting die 7 is removably anchored to the cutting roller 5, for example by means of a magnetic attraction force. The cutting die 7 can be conformed as a flexible plate 8, from which a plurality of projections 9 depart which behave as blades, able to penetrate through the thickness of the self-adhesive layer 11, determining a cutting thereof. The counter roller 6 is instead destined to come into contact with the support layer 10 for supporting the contrast roller during the cutting.

As shown in FIG. 6, the cutting roller 5 extends along a main axis A1, while the counter roller 6 extends along a longitudinal axis A2. A motor 12, shown in FIG. 2, is coupled to the cutting roller 5 so as to rotate the cutting roller 5 about the main axis A1. A further motor 13, also shown in FIG. 2, is coupled to the counter roller 6 so as to rotate the latter about the longitudinal axis A2.

The motor 12 and the further motor 13 are configured to rotate the cutting roller 5 and the counter roller 6 at respective rotation velocities that are selectable as a function of the velocity with which the strip material 14 crosses the cutting apparatus 1. In particular, the peripheral velocity of the cutting roller 5 and the peripheral velocity of the counter roller 6 are desired to be substantially equal to the velocity of the strip material 14, so that the cutting roller 5 and the counter roller 6 move in a synchronised way with the strip material 14.

The cutting apparatus 1 further comprises a position adjustment device for regulating the relative position of the main axis A1 and of the longitudinal axis A2. The position adjustment device is configured for varying the distance between the main axis A1 and the longitudinal axis A2, within a predetermined range. The position adjustment device is further configured for varying the inclination of an axis chosen from between the main axis A1 and the longitudinal axis A2 with respect to the other axis chosen from between the longitudinal axis A2 and the main axis A1, so that the main axis A1 and the longitudinal axis A2 can be arranged in a parallel position, or alternatively in an inclined position by an angle that can be selected from within a predetermined range.

In the illustrated example, the position adjustment device enables modifying the position of the main axis A1 while maintaining the position of the longitudinal axis A2 fixed, but a situation is also possible in which the position of the longitudinal axis A2 is varied with respect to the main axis A1, or in which the position of both the main axis A1 and the position of the longitudinal axis A2 are modified.

As shown in FIGS. 2 and 6, the position adjustment device comprises a front adjustment device 15 for regulating the relative position of the main axis A1 and of the longitudinal axis A2 in a front region of the cutting apparatus 1, i.e. in a region of the cutting apparatus 1 which, in use, is closer to the operator.

The position adjustment device further comprises a rear adjustment device 16 for regulating the relative position of the main axis A1 and of the longitudinal axis A2 in a rear region of the cutting apparatus 1, i.e. towards the rear of the cutting apparatus 1.

Figure 3:
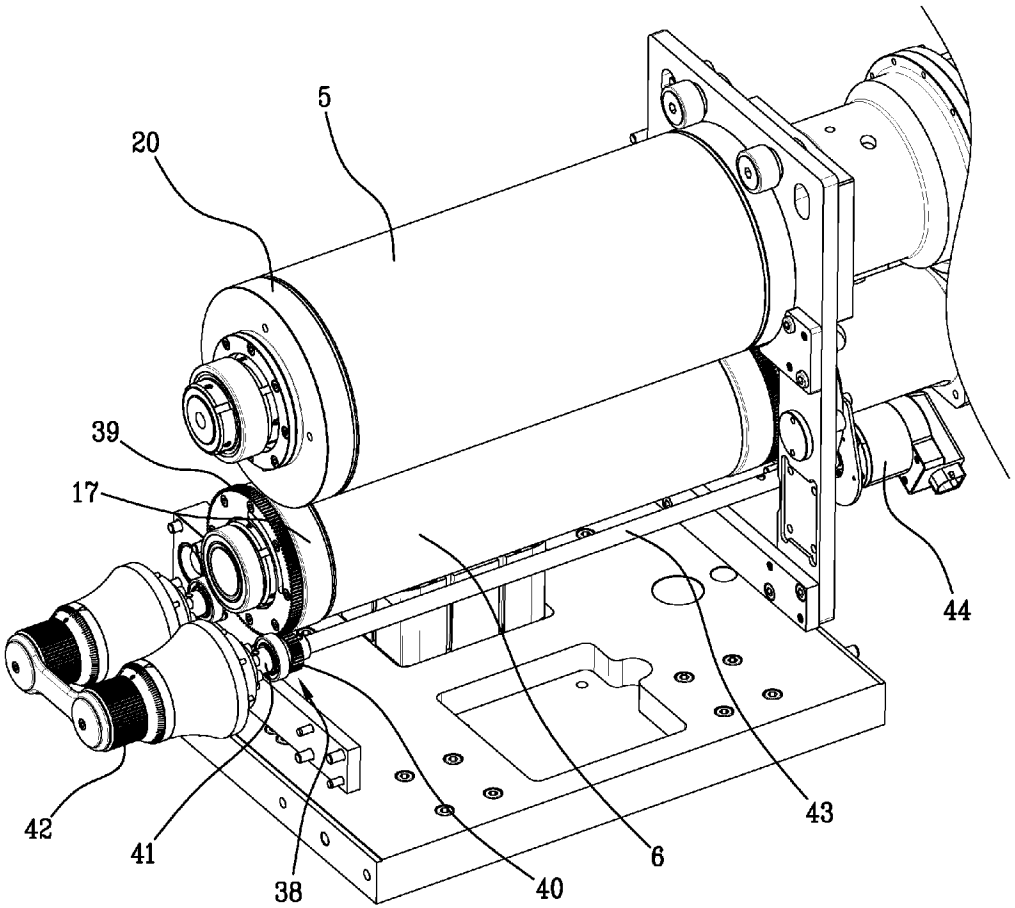
FIG. 3 is a perspective view of the cutting apparatus of FIG. 1, wherein some parts of an external casing and a front pressing device have been removed.
Figure 7:
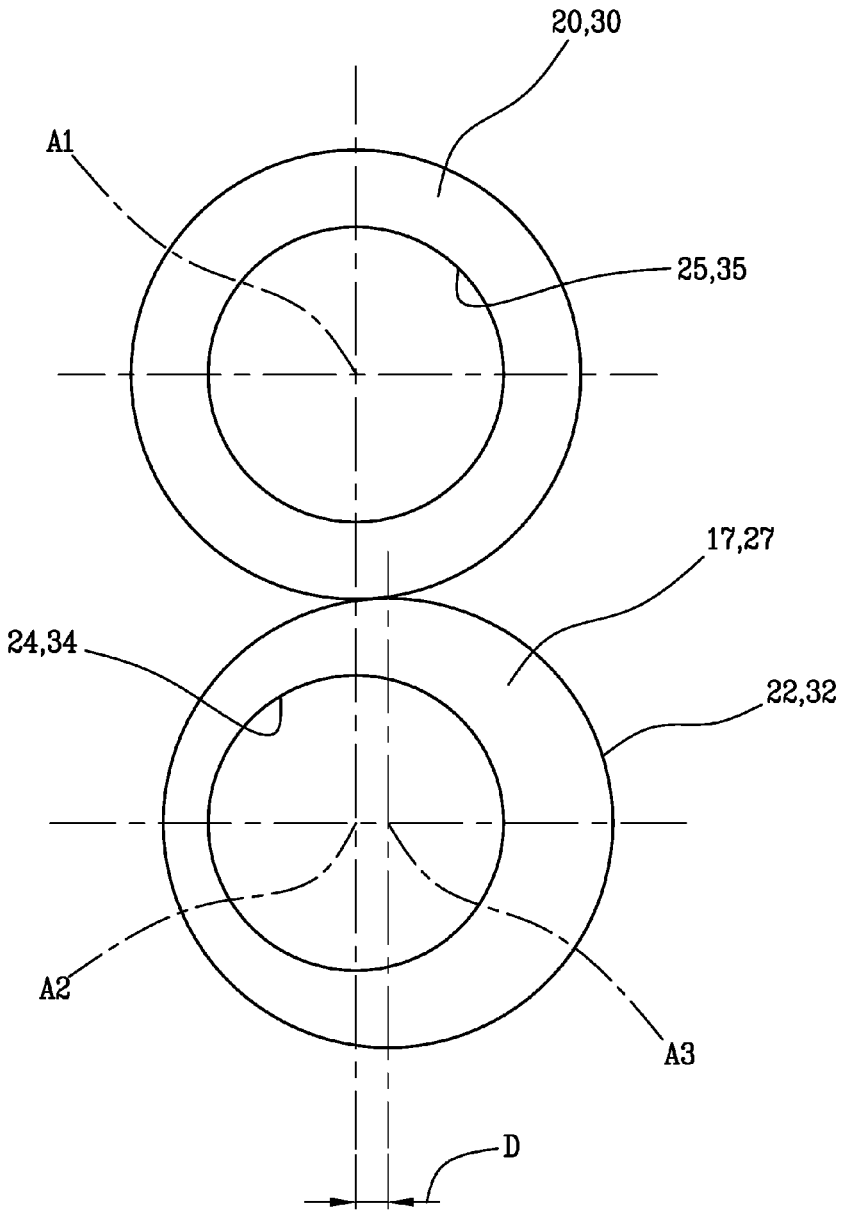
FIG. 7 is a schematic front view, not in scale, highlighting the profile of an eccentric element and an annular element of the apparatus of the cutting apparatus of FIG. 1.

As illustrated in FIGS. 3, 6 and 7, the front adjustment device 15 comprises a front eccentric element 17, in particular having an annular shape, associated to a front end of the counter roller 6. In the illustrated example, a bearing 18 is housed internally of the front eccentric element 17, splined on a front shank 19 which projects from the counter roller 6. The front shank 19 is fixed with respect to the counter roller 6 and can be realised in a single piece with the counter roller 6. The counter roller 6 can thus rotate with respect to the front eccentric element 17 which, during the cutting of the labels, is destined to remain in a fixed position.

Further provided is a front annular element 20, associated to a front end of the cutting roller 5 and able to interact with the front eccentric element 17 for determining the relative position of the main axis A1 and the longitudinal axis A2. A portion of front shaft 21, fixed with respect to the cutting roller 5, passes internally of the front annular element 20. A bearing 26 is interposed between the portion of front shaft 21 and the front annular element 20, in such a way that the cutting roller 5, during operation, can rotate with respect to the front annular element 20, which remains in a fixed position.

As shown in FIGS. 6 and 7, the front eccentric element 17 is delimited by an external surface 22, able to come into contact with a further external surface 23 which delimits the front annular element 20. The front eccentric element 17 is internally provided with a seating 24 for housing the bearing 18. The seating 24 is coaxial with the longitudinal axis A2.

The external surface 22 has a substantially cylindrical conformation and extends along a further longitudinal axis A3, shown in FIG. 7, which is parallel to the longitudinal axis A2 and is located at a distance D from the longitudinal axis A2. The distance D expresses the eccentricity of the external surface 22 with respect to the seating 24.

The further external surface 23 which delimits the front annular element 20 is substantially cylindrical and is coaxial with the main axis A1. A further seating 25 is fashioned internally of the front annular element 20 for housing the bearing 26. The further seating 25 extends coaxially to the main axis A1.

The rear adjustment device 16 is alike the front adjustment device 15 and comprises a rear eccentric element 27, in particular annular in shape, associated to a rear end of the counter roller 6. The rear eccentric element 27 is externally delimited by a surface 32 having a substantially cylindrical shape which—as already described with reference to the external surface 22 of the front eccentric element 17—is arranged eccentrically with respect to the longitudinal axis A2. A bearing 28 is arranged internally of a hole 34 fashioned on the rear eccentric element 27, which bearing 28 is mounted on a rear shank 29 of the counter roller 6. This enables the counter roller 6 to rotate with respect to the rear eccentric element 27, which remains in a fixed position while the cutting die 7 cuts the self-adhesive layer 11. The hole 34 is coaxial with the longitudinal axis A2.

The rear eccentric element 27 is configured for interacting with a rear annular element 30, associated to a rear end region of the cutting roller 5. The rear annular element 30 is delimited by a further surface 33, able to come into contact with the surface 32 of the rear eccentric element 27. The further surface 33 is substantially cylindrical and extends coaxially to the main axis A1.

A further hole 35 is fashioned internally of the rear annular element 30, in which a bearing 36 is housed. The bearing is splined on a portion of rear shaft 31, fixed with respect to the cutting roller 5. The cutting roller 5 can thus rotate about the main axis A1, with respect to the rear annular element 30 which does not move during the cutting of the labels. The further hole 35 is arranged coaxially to the main axis A1.

During operation, the cutting roller 5 and the counter roller 6 are arranged in an operating position P, illustrated in FIG. 6, in which the front annular element 20 is in contact with the front eccentric element 17. In particular, the external surface 22 is in abutment against the further external surface 23. Likewise, the rear annular element 30 is in contact with the rear eccentric element 27, because the surface 32 is in abutment against the further surface 33.

In this way, the relative position of the main axis A1 and the longitudinal axis A2 is determined, as well as the inclination thereof with respect to one another.

In the operating position P, the cutting roller 5 and the counter roller 6 are not in contact with one another. Between the cutting roller 5 and the counter roller 6 a slot 37 can be identified, i.e. an interspace or empty space which separates respective external surfaces of the cutting roller 5 and the counter roller 6. The slot 37 has a height H, which is selected as a function of the thickness of the cutting die 7 and of the support layer 10.

In particular, if S1 denotes the thickness of the support layer 10, and S2 denotes the thickness of the cutting die 7, taken as the sum of the height of the flexible plate 8 and the projections 9, the following relation results:

$$H=S1+S2$$

This ensures that the projections 9 penetrate into the thickness of the self-adhesive layer 11, resulting in the cutting, without interacting with the support layer 10, which remains whole.

The height H can be set by the position adjustment device, by modifying the angular position of the front eccentric element 17 and of the rear eccentric element 27 about the longitudinal axis A2, which remains in the fixed position.

By doing this, owing to the eccentricity D of the external surface 22 and the surface 32, the positions of the front annular element 20 and the rear annular element 30 are modified on respective planes arranged transversally, in particular perpendicularly, to the longitudinal axis A2. Consequently, the position of the main axis A1 is varied with respect to the longitudinal axis A2, and therefore the distance between the external surfaces of the cutting roller 5 and the counter roller 6, i.e. the height H of the slot 37, is also varied.

In particular, if—starting from a condition in which the main axis A1 and the longitudinal axis A2 are parallel to one another—the angular position of the front eccentric element 17 and the rear eccentric element 27 about the longitudinal axis A2 is varied simultaneously and by the same amount, the main axis A1 will continue to be parallel to the longitudinal axis A2 and the height H of the slot 37 will be modified so as to remain constant along the whole length of the slot 37, i.e. in a parallel direction to the longitudinal axis A2. This enables making the cutting apparatus 1 suitable for operating with cutting dies 7 of different thicknesses, and/or with strip materials 14 having different thicknesses.

If, on the other hand—starting from a condition in which the main axis A1 and the longitudinal axis A2 are parallel to one another—only the angular position of the front eccentric element 17 or the rear eccentric element 27 about the longitudinal axis A2 is varied, or also if those angular positions are modified in a different way to one another, the main axis A1 is arranged in an inclined configuration with respect to the longitudinal axis A2, and the height H is no longer constant along the slot 37 but will linearly vary, passing from a front end to a rear end of the slot 37, i.e. it varies linearly along a parallel direction to the longitudinal axis A2. In this way, it is possible to make the cutting apparatus 1 suitable for operating also with cutting dies 7 which, owing for example to the wear due to prolonged operation, have a thickness S2 that is not constant, but which—for example—varies by a greater value in proximity of the front annular element 20 to a lower value in proximity of the rear annular element 30, or vice versa.

There follows a description of the components of the cutting apparatus 1 which enable modifying the angular position of the front eccentric element 17 and of the rear eccentric element 27 about the longitudinal axis A2.

The front adjustment device 15 comprises a front drive system 38, visible for example in FIG. 3, for rotating the front eccentric element 17 about the longitudinal axis A2. The front drive system 38 comprises a toothed crown 39, arranged in a fixed position with respect to the front eccentric element 17. The toothed crown 39 extends about the longitudinal axis A2, i.e. it is coaxial with the seating 24 of the front eccentric element 17 and with the counter roller 6. The front drive system 38 further comprises a toothed pinion 40, configured for enmeshing with the toothed crown 39 and rotatable about a parallel axis to the longitudinal axis A2. By rotating the toothed pinion 40 about the respective axis, the toothed crown 39 is correspondingly rotated about the longitudinal axis A2, and consequently the angular position of the front eccentric element 17 is modified about the longitudinal axis A2. This enables varying the position of the main axis A1 in a frontal region of the cutting apparatus 1.

The toothed pinion 40 is mounted on a drive shaft 41 connected to a front control element 42, conformed for example as a knob, activatable by the operator to rotate the drive shaft 41 about the axis thereof, so as to regulate the angular position of the front eccentric element 17.

The drive shaft 41 is provided with a prolongation 43 which extends up to a rear region of the cutting apparatus 1 and is connected to an encoder 44, which enables detecting the angular position of the drive shaft 41. In this way it is possible to know, at any moment, the angular position of the toothed pinion 40 and, consequently, the angular position of the toothed crown 39 and the front eccentric element 17.

Figure 4:
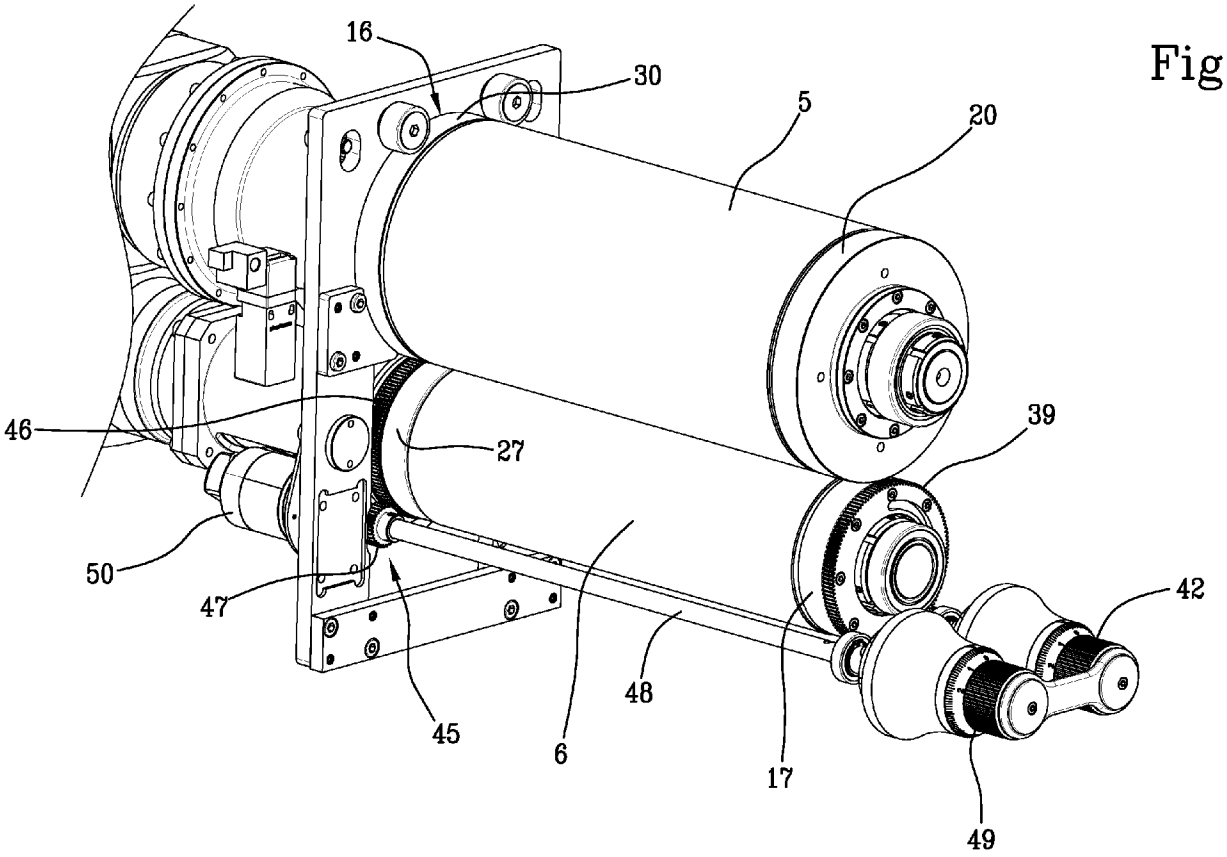
FIG. 4 is a view like the one in FIG. 3, taken from a different angle.

The rear adjustment device 16 comprises a rear drive system 45, visible for example in FIG. 4, for rotating the rear eccentric element 27 about the longitudinal axis A2. The rear drive system 45 is entirely alike the front drive system 38. In particular, the rear drive system 45 comprises a toothed wheel 46, mounted in a fixed position with respect to the rear eccentric element 27 and therefore rotatable solidly with the rear eccentric element 27 about the longitudinal axis A2. The toothed wheel 46 is coaxial with the hole 34 internally of which the rear shank 29 of the counter roller 6 is mounted. The toothed wheel 46 is therefore coaxial with the counter roller 6.

The rear drive system 45 further comprises a drive pinion 47, configured for enmeshing with the toothed wheel 46 so as to rotate the toothed crown about the longitudinal axis A2. The drive pinion 47 is rotatable about a parallel axis to the longitudinal axis A2. For this purpose, the drive pinion 47 is mounted on a drive rod 48 connected to a rear control element 49, conformed for example as a knob, activatable by the operator to rotate the drive rod 48 about the axis thereof, so as to regulate the angular position of the rear eccentric element 27.

When the operator rotates the rear control element 49, the drive pinion 47 is rotated which by enmeshing with the toothed wheel 46, rotates the toothed wheel 46 about the longitudinal axis A2. In this way the angular position of the rear eccentric element 27 about the longitudinal axis A2 is modified. The rear eccentric element 27 in turn displaces the rear annular element 30, which causes a variation in the position of the main axis A1 relative to the longitudinal axis A2.

A further encoder 50, which enables detecting the angular position of the drive rod 48, is mounted to a rear end of the drive rod 48, i.e. to an end of the drive rod 48 opposite the end at which the rear control element 49 is arranged. In this way it is possible to know, at any moment, the angular position of the drive pinion 47 and, consequently, the angular position of the toothed wheel 46 and the rear eccentric element 30.

The cutting apparatus 1 further comprises a pressing device for pressing 2 0 the cutting roller 5 and the counter roller 6 one against the other, in particular to push the cutting roller 5 towards the counter roller 6. Once the cutting roller 5 and the counter roller 6 have been positioned in the correct position by acting on the position adjustment device, by means of the pressing device it is possible to apply, on the cutting roller 5, a pressure that is sufficient to enable cutting the self-adhesive layer 11. The pressure applied by means of the pressing device enables preventing the strip material 14, which passes through the slot 37, from distancing the cutting roller 5 and the counter roller 6 from one another, which would compromise the precision of the cut.

In the illustrated example, the pressing device acts on the annular elements 20, 30 associated to the cutting roller 5, so as to push the annular elements 20, 30 towards the corresponding eccentric elements 17, 27. In other words, the pressing device acts on the cutting roller 5 via the annular elements 20, 30.

As shown in FIG. 2, the pressing device comprises a front pressing device 51, arranged so as to act on a region of front end of the cutting roller 5, and a rear pressing device 52, arranged so as to act on a rear end region of the cutting roller 5.

The front pressing device 51 comprises a pair of front presser elements 53, in particular conformed as wheels, which are arranged in contact with the front annular element 20. The front presser elements 53 are in particular in contact with an upper portion of the front annular element 20, i.e with a portion of the front annular element 20 further from the counter roller 6. The front presser elements 53 are arranged in a symmetrical position with respect to a vertical plane containing the main axis A1.

Likewise, the rear pressing device 52 comprises a pair of rear presser elements 63 conformed in particular as wheels, which are arranged in contact with an upper portion of the rear annular element 30. The rear presser elements 63 are also arranged symmetrically with respect to a vertical plane containing the main axis A1.

The front presser elements 53 are supported by a front support element 54, arranged in proximity of the front end of the cutting roller 5. Likewise, the rear presser elements 63 are supported by a rear support element 64, arranged in proximity of the rear end of the cutting roller 5. Both the front support element 54 and the rear support element 64 can be conformed as a bridge element, i.e. as an overturned U-shaped plate.

The front support element 54 and the rear support element 64 are connected to a base 55 of the cutting apparatus 1, the base 55 being in particular destined to be positioned horizontally during the operation of the cutting apparatus 1. The base 55 is arranged below the cutting roller 5 and the counter roller 6.

In particular, the front support element 54 and the rear support element 64 can be connected to the base 55 in such a way that the position thereof is adjustable in height with respect to the base 55.

The front support element 54 and the rear support element 64 are pneumatically activatable for varying the pressure acting on the annular elements 20, 30 associated to the cutting roller 5.

Figure 5:
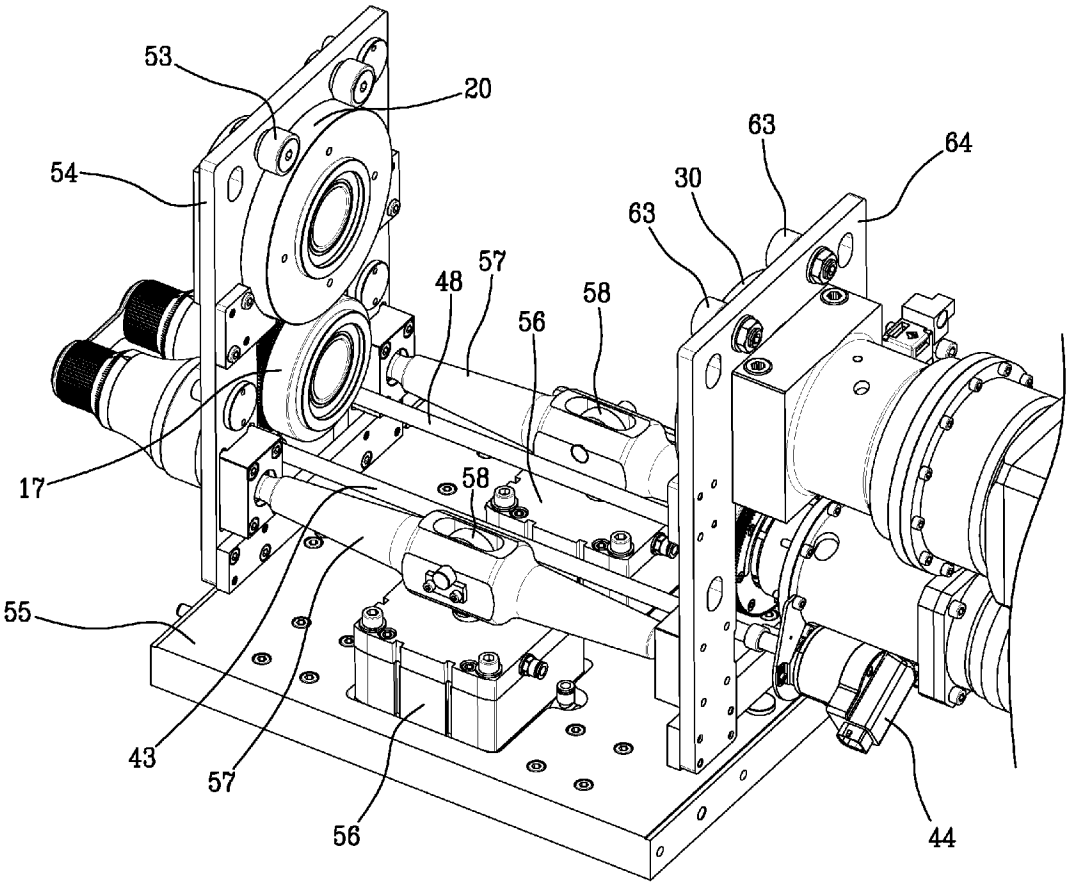
FIG. 5 is a perspective view of the cutting apparatus of FIG. 1, wherein some parts of the external casing, as well as a pair of rollers, have been removed.

For this purpose, two pneumatic cylinders 56 are included, visible for example in FIG. 5, which can be supported by the base 55, in particular housed internally of corresponding seatings fashioned in the base 55. The pneumatic cylinders 56 are arranged on opposite sides of the main axis A1 and of the longitudinal axis A2, in an intermediate position between the front support element 54 and the rear support element 64.

Each pneumatic cylinder 56 is connected to an intermediate region of a corresponding rocker arm 57, so that the rocker arm 57 can oscillate with respect to the respective cylinder. For this purpose, each cylinder 56 is provided with a rod fixed to an eyelet 58, internally of which a pin fixed to the rocker arm 57 is fixed.

Each rocker arm 57 extends along a direction that is substantially parallel to the main axis A1 and to the longitudinal axis A2.

Each rocker arm 57 has an end connected to the front support element 54 and a further end, opposite the above-mentioned end, connected to the rear support element 64. The connection between the ends of the rocker arm 57 and the support elements 54, 64 is such as to enable the ends of the rocker arm 57 to oscillate with respect to the support element 54, 64.

When the cutting roller 5 is to be pushed towards the support roller 7, the pneumatic cylinders 56 are activated in a direction such that the presser elements 53, 63 press against the respective annular elements 20, 30. In the illustrated example, this corresponds to applying—by means of the pneumatic fluid sent into the pneumatic cylinders 56—a force that tends to cause the rods of the pneumatic cylinders 56 to retract towards the inside of the cylinders. The support elements 54, 64 are thus pushed towards the base 55. Consequently, the presser elements 53, 63 supported by the support elements 54, 64 are pressed against the annular elements 20, 30. In this way the strip material 14 passing through the slot 37 is prevented from distancing the cutting roller 5 from the counter roller 6.

By pneumatically activating the presser elements 53, 63, it is possible to ensure that the cutting roller 5 is pushed towards the counter roller 6 with a constant pressure, corresponding to the pressure exerted by the pneumatic cylinders 56. This enables carrying out the cutting of the self-adhesive layer 11 in repeatable conditions and thus with high precision.

Further, as the ends of the rocker arms 57 can oscillate relative to the support elements 54, 64, the rocker arms 57 can be arranged in an oblique position with respect to the support elements 54, 64, i.e. in an inclined position with respect to the longitudinal axis A2. This enables uniformly pushing the cutting roller 5 towards the counter roller 6 even when the main axis A1 is arranged in a non-parallel position to the longitudinal axis A2, for example in order to be able to work with a worn cutting die 7. It is thus guaranteed that the pressure applied to the strip material 14 is uniform along the slot 37, even in a case where the slot has a height that varies linearly from one end to the other of the slot.

Lastly, it is clear from what is described above that the position adjustment device, by means of which it is possible to adjust the relative position of the cutting roller 5 and the counter roller 6, is distinct and independent from the pressing device, by means of which the cutting roller 5 is pushed towards the counter roller 6. In this way, it is possible—in an initial step—to correctly position the cutting roller 5 with respect to the counter roller 6, by acting on the front adjustment device 15 and on the rear adjustment device 16. This can be done simply and reliably owing to the eccentric elements 17, 27.

In greater detail, knowing the thickness S1 of the support layer 10 and the thickness S2 of the cutting die 7, it is possible to determine the height H theoretically required for the slot 37. This corresponds to a predetermined angular position of the eccentric elements 17, 27 which can be easily calculated, as the geometry of the system is of known type, as is also the current angular position of the eccentric elements 17, 27 (thanks to the encoder 44 and the further encoder 50). The eccentric elements 17, 27 are now positioned in the angular position calculated.

It is therefore particularly simple to predispose the cutting apparatus 1 in a configuration ready for operation, reducing, practically, to zero the number of attempts at cutting which it is necessary to carry out before obtaining the depth of cut requested, independently of the experience and/or the professional capabilities of the operator.

At this point, it is possible to activate the pressing device, so that the cutting roller 5 is pressed against the counter roller 6 and the relative axes A1, A2 remain in the fixed position during the cut. The pressing device does not however vary the relative position of the main axis A1 and the longitudinal axis A2.

The cutting apparatus 1 is now ready to function.

The position adjustment device can be used also while the cutting apparatus 1 is operating. If it is found that the labels are cut in an incorrect way, for example because the cutting die 7 is becoming worn, it is possible to act on the eccentric elements 17, 27 so as to regulate the distance between the main axis A1 and the longitudinal axis A2, or the inclination of the main axis A1 with respect to the longitudinal axis A2, without stopping the cutting apparatus 1. This enables maintaining a good cut quality, without there being any loss of productivity due to halts of the cutting apparatus 1.

In a version that is not illustrated, it is possible to increase the ease of use of the cutting apparatus 1 using, instead of control elements 42, 49 conformed as knobs, respective motors configured so as to rotate the drive shaft 41 and the drive rod 48. In this way, the relative position of the main axis A1 and the longitudinal axis A2 can be varied completely automatically.

Although, in the description of the figures, reference has consistently been made to a cutting roller 5 and an counter roller 6, it is understood that the position adjustment device and the pressing device might be used also in combination with rollers to which different work tools to the cutting die 7 are associated, for example embossing tools for fashioning reliefs on the flexible material, or scoring tools.

The invention claimed is:

1. An apparatus for processing a flexible material (14), comprising:

a first roller (5) extending along a main axis (A1);

a second roller (6) extending along a longitudinal axis (A2), the first roller (5) and the second roller (6) being mutually co-operating to carry out an operation on the flexible material (14), an interspace (37) being defined between the first roller (5) and the second roller (6) so that the flexible material (14) may pass through the interspace (37);

a pressing device for pushing the first roller (5) and the second roller (6) one towards another;

a position adjustment device for adjusting the relative position of the first roller (5) and the second roller (6), the position adjustment device being distinct from the pressing device;

a pair of contact elements (17, 20) mounted at a front end respectively of the first roller (5) and second roller (6), and a further pair of contact elements (27, 30) mounted at a rear end respectively of the first roller (5) and second roller (6), the contact elements (17, 20) of said pair being arranged in mutual contact, and the contact elements (27,30) of said further pair being arranged in mutual contact, so as to define said interspace (37);

wherein the pressing device comprises at least two pressing elements (53) which are arranged in contact with angularly spaced zones of a contact element (17, 20) of said pair, and at least two further pressing elements (63) which are arranged in contact with angularly spaced zones of a contact element (27, 30) of said further pair;

characterised in that said pressing device comprises a pair of pneumatic cylinders (56) to which corresponding pivoting rocker arms (57) are connected, each rocker arm (57) being connected to a pair of support elements (54, 64) in a tiltable manner the support elements (54, 64) supporting said pressing elements (53) or respectively said further pressing elements (63).

2. An apparatus according to claim 1, wherein the position adjustment device is configured to change the distance between said main axis (A1) and said longitudinal axis (A2), so as to vary the height (H) of the interspace (37).

3. An apparatus according to claim 1, wherein the position adjustment device comprises a front adjustment device (15), which is associated with respective front ends of the first roller (5) and of the second roller (6), and a rear adjustment device (16), which is associated with respective rear ends of the first roller (5) and of the second roller (6).

4. An apparatus according to claim 3, wherein the front adjustment device (15) and the rear adjustment device (16) are operable independently of each another, so that the main axis (A1) and the longitudinal axis (A2) may be arranged in an oblique position relative to one another.

5. An apparatus according to claim 1, wherein a contact element (17, 20, 27, 30) of said pair and/or of said further pair comprises an eccentric element (17, 27) included in the position adjustment device, the eccentric element (17, 27) being in contact with the other contact element (20, 30) of said pair and/or of said further pair so that, by rotating the eccentric element (17, 27) about the axis of the roller to which the eccentric element (17, 27) is associated, there is a change in the position of the axis of the roller to which the contact element (20, 30), co-operating with the eccentric element (17, 27), is associated.

6. An apparatus according to claim 5, and further comprising a drive system for rotating the eccentric element (17, 27) about the axis of the roller to which the eccentric element (17, 27) is associated.

7. An apparatus according to claim 6, wherein the drive system comprises a toothed wheel (39, 46) which is fixed relative to the eccentric element (17, 27), a further toothed wheel (40, 47) being provided for engaging with said toothed wheel (39, 46), so as to rotate the eccentric element (17, 27) about the axis of the roller to which the eccentric element (17, 27) is associated.

8. An apparatus according to claim 7, and further comprising a control element (42, 49) associated with a shaft (41, 48) on which said toothed wheel (39, 46) is mounted, the control element (42, 49) being manually rotatable for rotatingly driving the shaft (41, 48).

9. An apparatus according to claim 7, and further comprising a control element associated with a shaft (41, 48) on which said toothed wheel (39, 46) is mounted, the control element comprising a motor for rotating the shaft.

10. An apparatus according to claim 1, wherein said pressing elements (53) and said further pressing elements (63) may be pressed pneumatically against the corresponding contact elements (17, 20, 27, 30).

11. An apparatus according to claim 1, wherein the first roller (5) supports a cutting die (8) for cutting the flexible material (14), the second roller (6) being a counter roller for supporting the flexible material (14) during cutting.

* * * * *